US007664443B2

(12) United States Patent
Park

(10) Patent No.: US 7,664,443 B2
(45) Date of Patent: Feb. 16, 2010

(54) IMAGE FORMING APPARATUS HAVING IMPROVED HOME POSITION SENSING STRUCTURE OF TRANSFER BELT, AND METHOD OF DISPOSING HOME POSITION SENSING APPARATUS OF TRANSFER BELT FOR IMAGE FORMING APPARATUS

(75) Inventor: Moon-bae Park, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 545 days.

(21) Appl. No.: 11/489,516

(22) Filed: Jul. 20, 2006

(65) Prior Publication Data

US 2007/0019999 A1 Jan. 25, 2007

(30) Foreign Application Priority Data

Jul. 21, 2005 (KR) ..... 10-2005-0066453

(51) Int. Cl.
*G03G 15/01* (2006.01)

(52) U.S. Cl. ..... 399/302

(58) Field of Classification Search ..... 399/302
See application file for complete search history.

(56) References Cited

U.S. PATENT DOCUMENTS

2001/0007617 A1 7/2001 Nakamura

FOREIGN PATENT DOCUMENTS

| | | |
|---|---|---|
| JP | 08-314235 | 11/1996 |
| JP | 09-160316 | 6/1997 |
| JP | 2002-296971 | 10/2002 |
| KR | 1020040068442 | 7/2004 |

*Primary Examiner*—David M Gray
*Assistant Examiner*—Andrew V Do
(74) *Attorney, Agent, or Firm*—Roylance, Abrams, Berdo & Goodman, L.L.P.

(57) ABSTRACT

An image forming apparatus includes a transfer belt having a light penetrating portion formed at one side of an edge portion of the transfer belt, a protection tape adhered to both sides of the edge portion to cover the light penetrating portion, and a guide member attached to one side of the protection tape. A plurality of rotation rollers drive the transfer belt in a caterpillar-type manner and include a guide groove formed at both ends of each rotation roller such that the guide member is inserted therein. A sensing body receives one end of the transfer belt to be positioned therein. A first sensing element and a second sensing element are disposed at both sides of the transfer belt such that a second distance from a transfer surface of the transfer belt to the second sensing element is longer than a first distance from the other surface of the transfer belt to the first sensing element.

19 Claims, 6 Drawing Sheets

IMAGE FORMING APPARATUS HAVING IMPROVED HOME POSITION SENSING STRUCTURE OF TRANSFER BELT, AND METHOD OF DISPOSING HOME POSITION SENSING APPARATUS OF TRANSFER BELT FOR IMAGE FORMING APPARATUS

CROSS-REFERENCE TO RELATED APPLICATIONS

This application claims the benefit under 35 U.S.C. § 119 (a) of Korean Patent Application No. 2005-66453, filed on Jul. 21, 2005, the entire contents of which are hereby incorporated by reference.

BACKGROUND OF THE INVENTION

1. Field of the Invention

The present invention relates to an image forming apparatus having an improved home position sensing structure of a transfer belt, and a method of disposing a home position sensing apparatus of the transfer belt for the image forming apparatus.

2. Description of the Related Art

Generally, a color image forming apparatus using an electro-photographic method forms an electrostatic latent image by scanning light onto a photosensitive medium charged at a predetermined electric potential. The electrostatic latent image is developed by using predetermined toner of a development unit. The electrostatic latent image is transferred onto a recording medium by a transfer unit. A color image is then formed by a settlement unit. Color toners for the color image forming apparatus are usually yellow (Y), magenta (M), cyan (C) and black (K), and four development units are required to form the four color toner, respectively.

FIG. 1 shows a structure of a photosensitive medium and a transfer unit of a conventional image forming apparatus.

With reference to FIG. 1, a photosensitive drum 1 is employed as the photosensitive medium, and a transfer belt 3 is employed as the transfer unit. Reference numerals 5A-5E in FIG. 1 denote rotation rollers supporting the transfer belt, which is driven in a caterpillar-type manner.

The electrostatic latent image formed on the photosensitive drum 1 is reproduced as a toner image by a developing device (not shown), and each color toner image is sequentially overlapped on the transfer belt 3 to form a color toner image. This transferring process is important since it influences the quality of printing. Thus, when sequentially transferring the toner image formed on the photosensitive drum 1 onto the transfer belt 3 by each color, the image should be transferred without misaligning each color. Herein, it is required to accurately synchronize the point in time of forming the electrostatic latent image on the photosensitive drum 1 with that on the transfer belt 3.

In the conventional art, a sensor 10 senses a home position of the transfer belt, and then a color printing initial position is determined by using the home position as a standard for forming the electrostatic latent image.

FIG. 2 is a sectional view taken along the line II-II' of FIG. 1, showing a structure of a sensor sensing a home position of a transfer belt.

With reference to FIG. 2, a light penetrating portion 5 is provided at one side of one end of the transfer belt 3, and protection tapes 7*a* and 7*b* are adhered to both sides of both ends of the transfer belt 3. A guide member 9 is positioned on the protection tape 7*b* attached to the other surface of the transfer belt 3 having a transfer surface 3*a*. The guide member

9 guides the transfer belt 3 to be regularly driven in the caterpillar-type manner without breaking away from the track and is slidedly inserted in guide grooves 5A'-5E' (referring to FIG. 1) formed at both ends of the rotation rollers 5A-5E. An external surface of the transfer belt 3, that is, the surface in contact with the photosensitive drum 1, is the transfer surface 3*a*.

The sensor 10 includes a sensor body 15 having a first sensing element 11 (a light emitting portion) and a second sensing element 13 (a light receiving portion) that are positioned to be spaced from both sides of the transfer belt 3, respectively. The sensor 10 in the aforementioned structure emits a predetermined light from the light emitting portion 11 and senses a home position of the transfer belt 3 according to whether the light receiving portion 13 receives the light. That is, when the light penetrating portion 5 of the transfer belt 3 driven in the caterpillar-type manner is positioned in the path through which the light passes, the light emitted from the light emitting portion 11 penetrates the light penetrating portion 5 and reaches the light receiving portion 13. Sensing such a state, the home position of the transfer belt 3 is sensed.

However, in the conventional sensing structure described above, there is a problem in that a distance between the transfer surface 3*a* of the transfer belt 3 driven in the caterpillar-type manner and the light receiving portion 13 is short. In this case, if the transfer belt 3 droops due to a length change, a tension change or tension inequality at both ends of the transfer belt 3 resulting from the breakaway of the transfer belt 3 from the track, the transfer surface 3*a* interferes with the light receiving portion 13. Consequently, the interference with the light receiving portion 13 causes sensing errors.

Furthermore, if scattering toner is stuck, this also becomes a factor of contaminating the light receiving portion 13, thereby causing sensing errors.

Accordingly, a need exists for an image forming apparatus having an improved sensing device in which the transfer belt does not interfere with the sensing element.

SUMMARY OF THE INVENTION

Accordingly, it is an object of the present invention to provide an image forming apparatus having an improved home position sensing structure of a transfer belt that substantially prevents interference with a sensor sensing the home position of the transfer belt.

Another object of the present invention is to provide a method of disposing a home position sensing apparatus of a transfer belt to substantially prevent interference with a sensor sensing the home position of the transfer belt.

In accordance with a first exemplary embodiment of the present invention, an image forming apparatus has an improved home position sensing structure of a transfer belt. The image forming apparatus includes a transfer belt having a light penetrating portion formed at one side of an edge portion of the transfer belt, a protection tape adhered to both sides of the edge portion to cover the light penetrating portion, and a guide member attached to one side of the protection tape. A plurality of rotation rollers drive the transfer belt in a caterpillar-type manner and include a guide groove formed at both ends of each rotation roller such that the guide member is inserted therein. A sensing body receives one end of the transfer belt to be positioned within the inside thereof. A first sensing element and a second sensing element are disposed inside of the sensing body such that a second distance from a transfer surface of the transfer belt to the second sensing element is longer than a first distance from the other surface of the transfer belt to the first sensing element.

Preferably, the sensing body may be positioned to be inclined in the opposite direction of the transfer surface of the transfer belt such that the second sensing element is positioned to be further away from the corresponding transfer surface of the transfer belt.

Preferably, the sensing body may be further moved from a central axis of a whole thickness formed by the protection tape, the transfer belt and the guide member, in a direction in which the transfer surface is formed.

Preferably, the sensing body may be positioned to be close to a driving roller in contact with driving power, among the plurality of rotation rollers. In accordance with a second exemplary embodiment of the present invention, an image forming apparatus has an improved home position sensing structure of a transfer belt. A light penetrating portion is formed at an edge portion of the transfer belt. A sensing body receives one end of the transfer belt to be positioned within the inside thereof. A first sensing element and a second sensing element are disposed inside of the sensing body such that a second distance from a transfer surface of the transfer belt to the second sensing element is longer than a first distance from the other surface of the transfer belt to the first sensing element.

Preferably, the sensing body may be positioned to be inclined, at a predetermined angle, in the opposite direction of the transfer surface of the transfer belt, such that the second sensing element is positioned to be further away from the corresponding transfer surface of the transfer belt.

Preferably, the sensing body may be further moved from a central axis of a thickness of the transfer belt in a direction where the transfer surface is formed.

Preferably, the sensing body may be positioned at a position close to a driving roller to which power to drive the transfer belt in a caterpillar-type manner is transferred.

In accordance with a third exemplary embodiment of the present invention, a color image forming apparatus includes a photosensitive drum being capable of forming an electrostatic latent image on its outer surface and a development unit forming a visible image by sequentially supplying different toner to the electrostatic latent image formed on the photosensitive drum. A transfer belt driven in a caterpillar-type manner contacts the photosensitive drum to transfer the visible image formed on the photosensitive drum onto a recording medium. A light penetrating portion is formed at an edge portion of the transfer belt, and includes a protection tape adhered to both sides of the edge portion to cover the light penetrating portion. A guide member is attached at one side of the protection tape. A transfer roller transfers a color image formed on the transfer belt onto the recording medium passing the transfer roller in contact with the transfer belt. A plurality of rotation rollers include a guide groove formed at both ends of each rotation roller into which the corresponding guide member is slidedly inserted when the transfer belt is driven in the caterpillar-type manner. A sensing body receives one end of the transfer belt to be positioned within the inside thereof. A first sensing element and a second sensing element are disposed inside of the sensing body such that a second distance from a transfer surface of the transfer belt to the second sensing element is longer than a first distance from the other surface of the transfer belt to the first sensing element.

In accordance with a fourth exemplary embodiment of the present invention, a method of disposing a home position sensing apparatus of a transfer belt for an image forming apparatus includes disposing one end of the transfer belt to be positioned within a sensing body that supports a first sensing element and a second sensing element, which substantially correspond to each other and are spaced apart by a predetermined distance. The one end of the transfer belt is positioned between the first sensing element and the second sensing element such that a second distance from a transfer surface of the transfer belt to the second sensing element is longer than a first distance from the other surface of the transfer belt to the first sensing element.

Preferably, the sensing body may be positioned to be inclined, at a predetermined angle, in the opposite direction of the transfer surface of the transfer belt, such that the second sensing element is positioned to be further away from the corresponding transfer surface of the transfer.

Preferably, the sensing body may be further moved, at a predetermined distance, from a central axis of a thickness of the transfer belt, in a direction where the transfer surface is formed.

Preferably, the sensing body may be positioned to be close to a driving roller in contact with driving power, among the plurality of rotation rollers rotating the transfer belt.

In accordance with a fifth exemplary embodiment of the present invention, a method of disposing a home position sensing apparatus of a transfer belt for an image forming apparatus includes disposing a transfer belt to be positioned within a sensing body that supports a first sensing element and a second sensing element, which substantially correspond to each other and are spaced apart by a predetermined distance. The transfer belt includes a light penetrating portion formed at one side of an edge portion of the transfer belt, and a protection tape adhered to both sides of the edge portion to cover the light penetrating portion. A guide member is attached to one side of the protection tape. One end of the transfer belt is positioned between the first sensing element and the second sensing element such that a second distance from a transfer surface of the transfer belt to the second sensing element is longer than a first distance from the other surface of the transfer belt to the first sensing element.

Preferably, the sensing body may be positioned to be inclined, at a predetermined angle, in the opposite direction of the transfer surface of the transfer belt, such that the second sensing element is positioned to be further away from the corresponding transfer surface of the transfer belt.

Preferably, the sensing body may be further moved, at a predetermined distance, from a central axis of a whole thickness formed by the protection tape, the transfer belt and the guide member, in a direction where the transfer surface is formed.

Preferably, the sensing body may be positioned to be close to a driving roller in contact with driving power, among the plurality of rotation rollers rotating the transfer belt.

In accordance with the exemplary embodiments of the present invention, interference of the transfer belt with the sensing element is substantially eliminated by improving the position where the home position sensing sensor of the transfer belt is disposed. Accordingly, reliability in sensing the home position of the transfer belt is improved.

Other objects, advantages, and salient features of the invention will become apparent from the detailed description, which, taken in conjunction with the annexed drawings, discloses preferred exemplary embodiments of the invention.

BRIEF DESCRIPTION OF THE DRAWINGS

The above aspects and features of the present invention will be more apparent by describing certain embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

Below, exemplary embodiments of the present invention are described in detail with reference to the included drawings.

Figure 1:
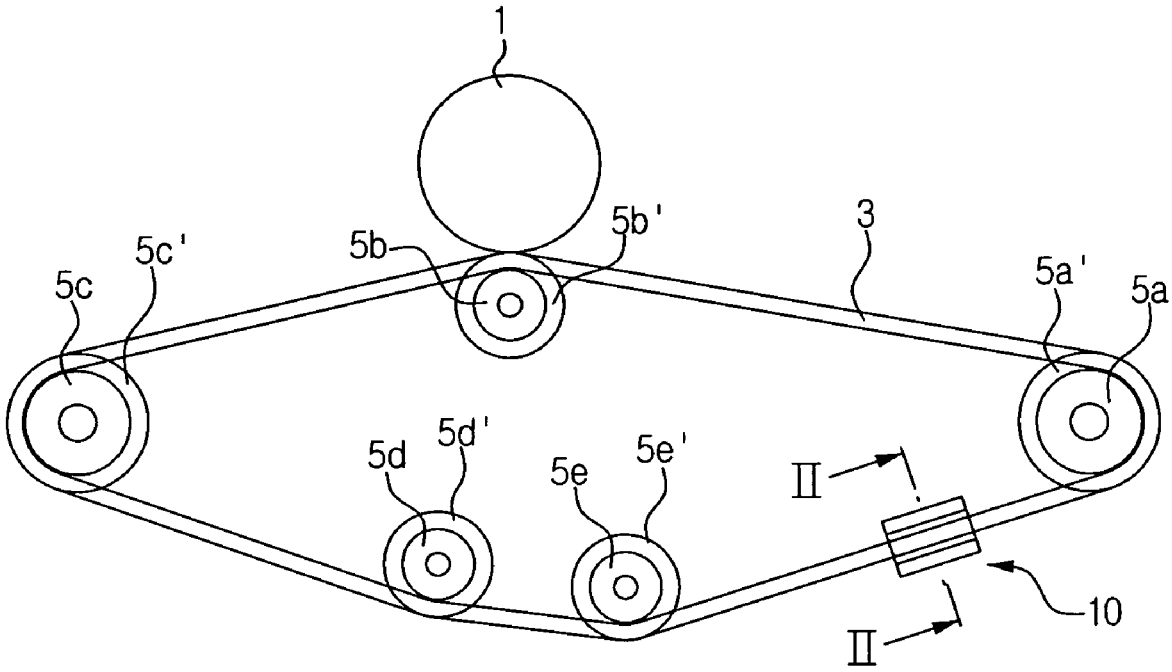
FIG. 1 (PRIOR ART)
FIG. 1 shows a structure of a photosensitive medium and a transfer unit according to a conventional image forming apparatus.
Figure 2:
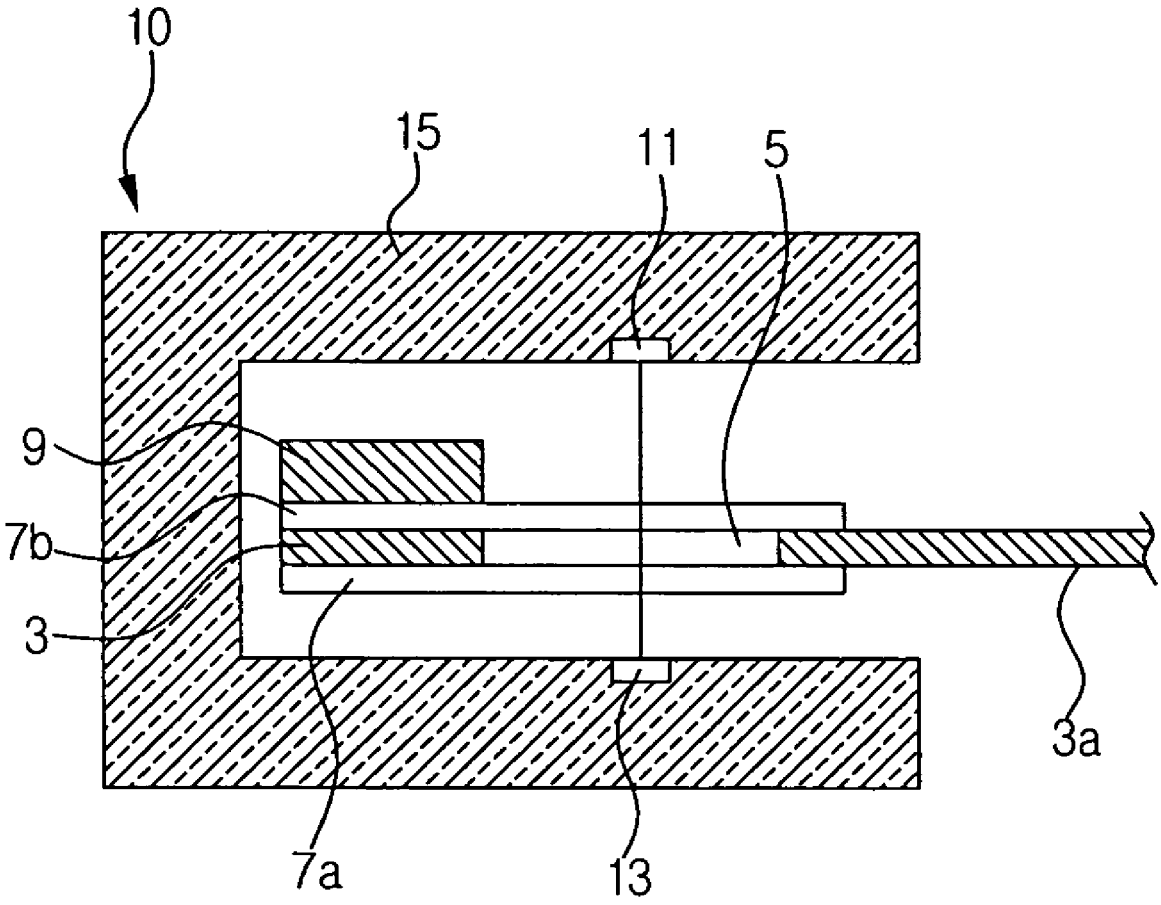
FIG. 2 (PRIOR ART)
FIG. 2 is a sectional view taken along a line II-II' of FIG. 1 showing a structure of a home position sensing sensor of a transfer belt.
Figure 3:
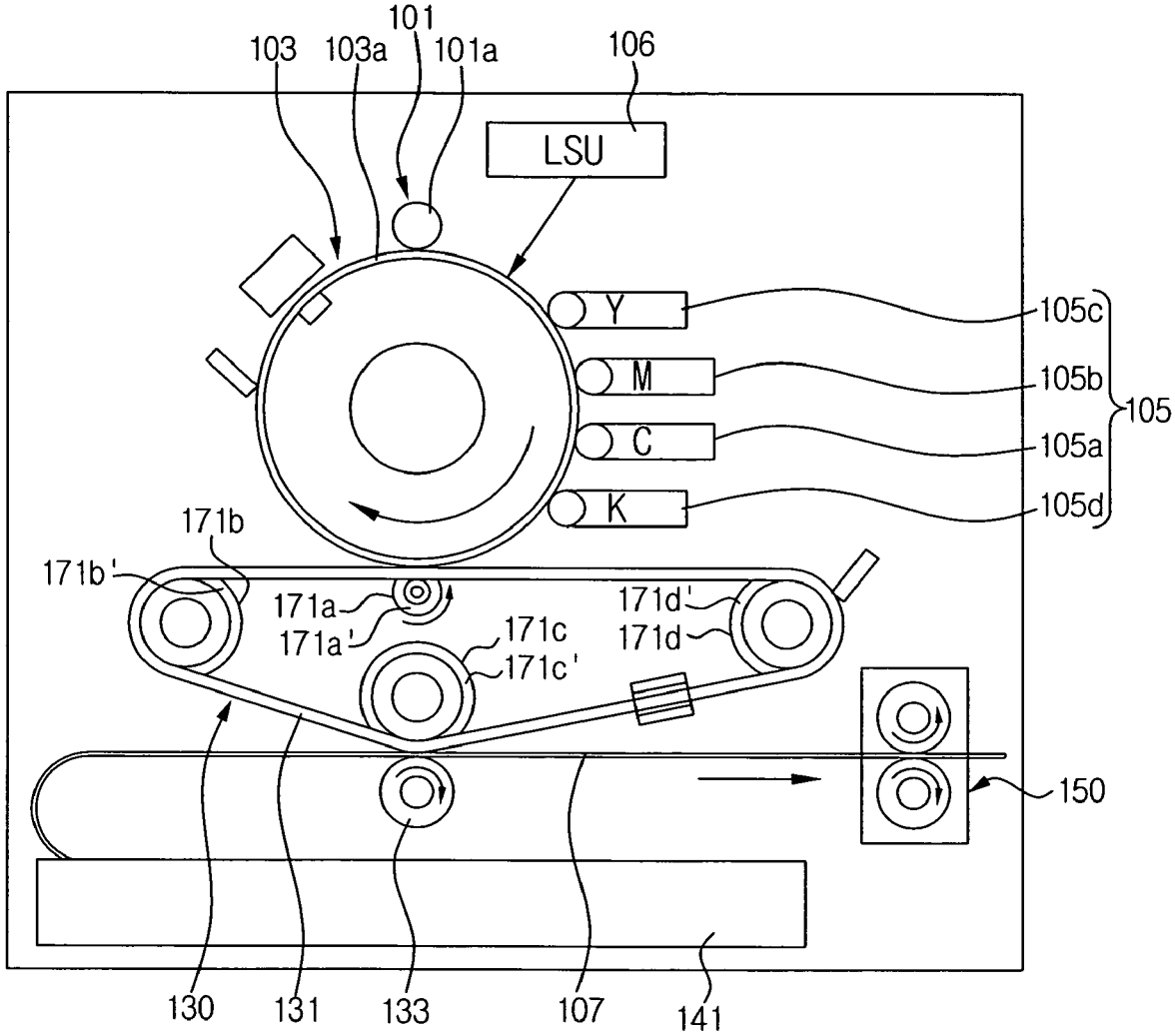
FIG. 3 is a schematic diagram of an image forming apparatus according to one embodiment of the present invention.

FIG. 3 schematically shows a schematic diagram of an image forming apparatus according to one exemplary embodiment of the present invention.

With reference to FIG. 3, an external circumferential surface of a photosensitive drum 103*a* as a photosensitive unit 103 is charged at an uniform electric differential by a charge unit 101, for example, a charge roller 101*a*. A light signal corresponding to image information, for example, a cyan (C) color, is scanned onto the external surface of the photosensitive drum 103*a* by an exposure unit 106, such as a laser scanning unit (LSU), such that an electrostatic latent image is formed on the external surface of the photosensitive drum 103*a*.

When the electrostatic latent image approaches a cyan developing device 105*a* of a development unit 105 while the photosensitive drum 103*a* rotates, the cyan color toner is attached to the electrostatic latent image to form a cyan-colored toner image. Then, the cyan color toner image is transferred to a transfer belt 131 of a transfer unit 130 by the rotation of the photosensitive drum 103*a*.

The cyan color toner image is completely formed onto the transfer belt 131 and, then, for example, the toner of a magenta (M) developing device 105*b*, a yellow (Y) developing device 105*c* and a black (K) developing device 105*d* is overlapped onto the transfer belt 131 through the aforementioned processes, such that a color toner image is formed.

Then, when a recording medium 107 supplied from a cassette 141 passes between the transfer belt 131 and the transfer roller 133, the color toner image formed on the transfer belt 131 is transferred onto the recording medium 107. Consecutively, the color toner image is settled in the recording medium 107 by the heat and the pressurizing force of a settlement unit 150 and is ejected to an ejecting portion (not shown), thereby completing a color image forming process.

Figure 4:
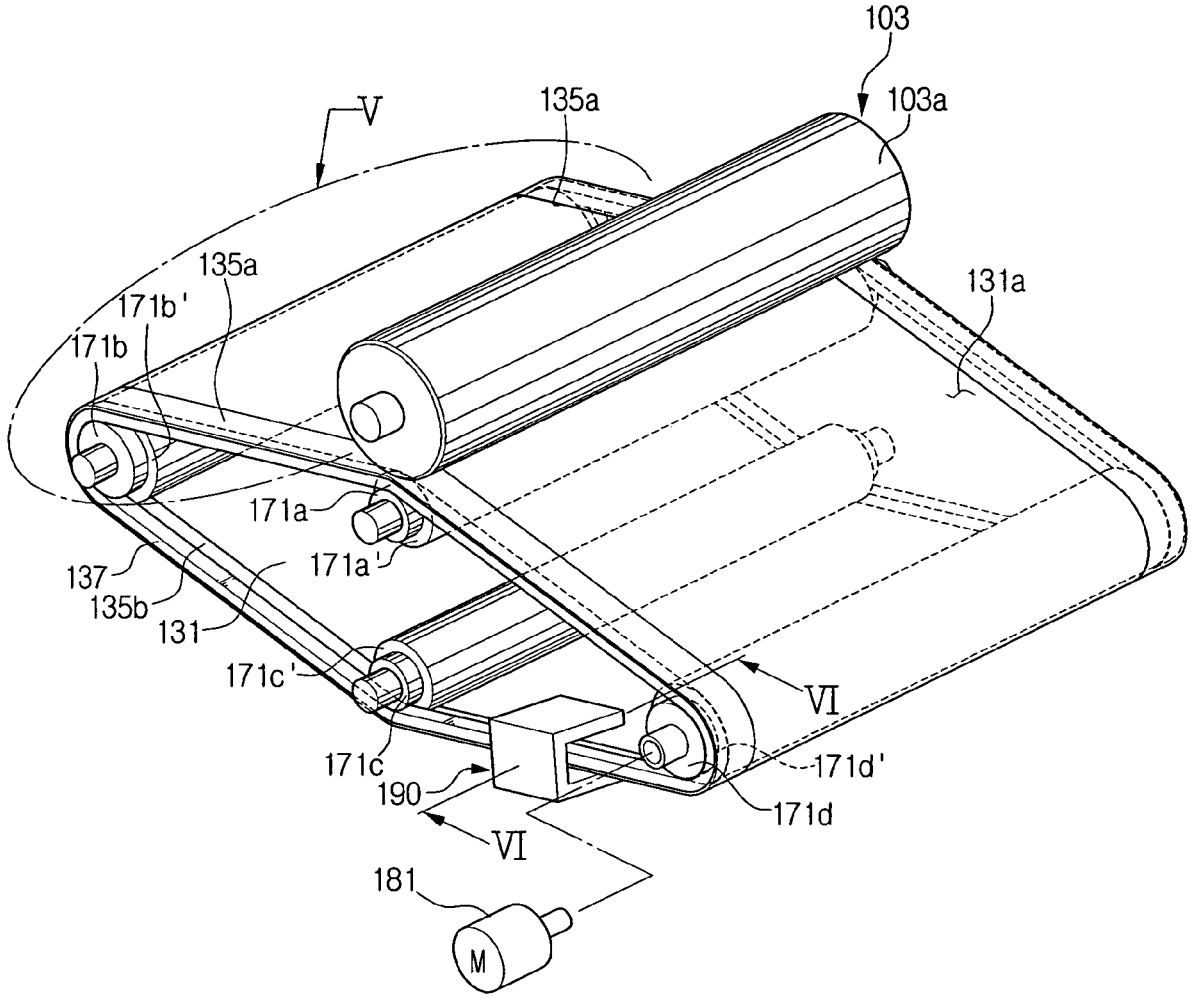
FIG. 4 is a perspective view of a transferring portion for an image forming apparatus having a home position sensing sensor of the transfer belt according to an exemplary embodiment of the present invention.
Figure 5A:
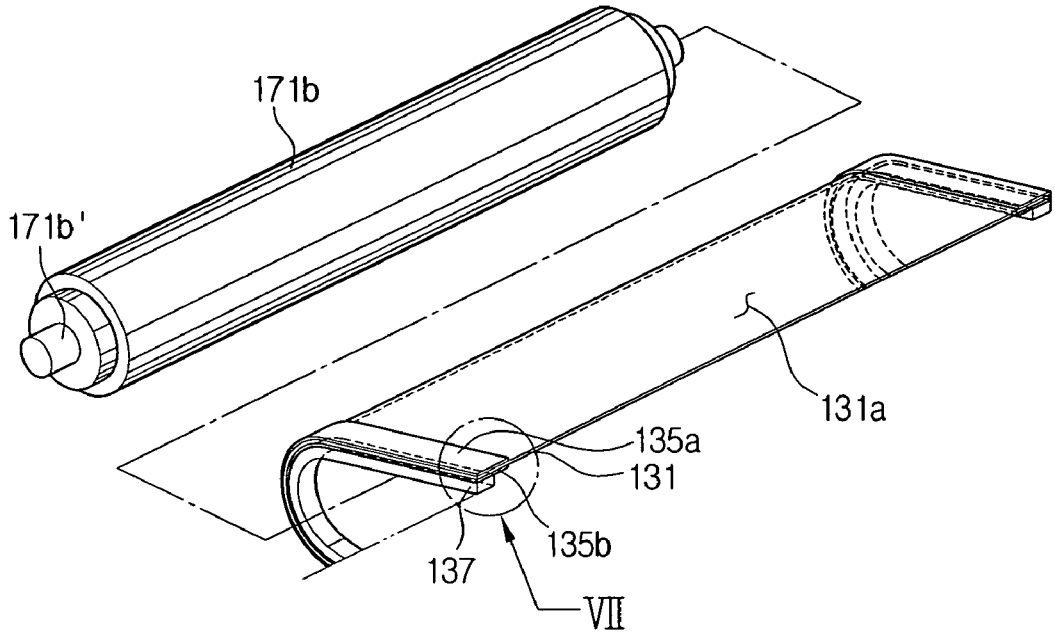
FIG. 5A is an exploded perspective view of a part of the transfer belt as cut, separating part V of FIG. 4.
Figure 5B:
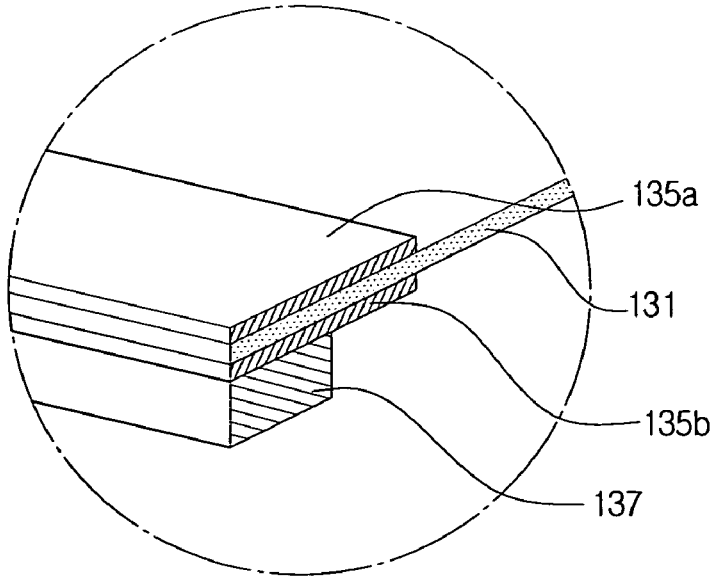
FIG. 5B is an enlarged perspective view of part VII of FIG. 5A.

FIG. 4 is a perspective view of a transferring portion of an image forming apparatus having a home position sensing sensor of a transfer belt according to an exemplary embodiment of the present invention. FIG. 5A is a perspective view showing a part of a transfer belt as cut, in which part V of FIG. 4 is separated. FIG. 5B is an enlarged view of part VII of FIG. 5A.

With reference to FIGS. 4, 5A and 5B, the external surface of the transfer belt 131 forms a transfer surface 131*a* on which the color image is formed. Protection tape 135*a* and 135*b* is attached to both sides of both ends of the transfer belt 131. A guide member 137 is attached on the upper side of the protection tape 135*a* and 135*b* to prevent the transfer belt 131 from breaking away from the track while the transfer belt 131 supported by rotation rollers 171*a*-171*d* is driven in a caterpillar-type manner. The guide member 137 is made of, for example, urethane materials, and is slidably inserted in guide grooves 171*a*'-171*d*' formed on the rotation rollers 171*a*-171*d*. The protection tape 135*a* and 135*b* prevents the transfer belt 131 from being damaged while the transfer belt 131 is driven in the caterpillar-type manner.

A sensing unit 190 is further included to sense a home position of the transfer belt 131 and to determine a color printing initial position by using the home position as a standard for forming the electrostatic latent image. The sensing unit 190 includes a sensing element (illustrated as a light receiving portion 193 in the drawings) positioned to be further away from the transfer surface 131*a* of the transfer belt 131. Consequently, this substantially prevents interference with the sensing element, thereby effectively reducing any sensing errors from occurring.

A sensing structure is described in more detail below.

Figure 6:
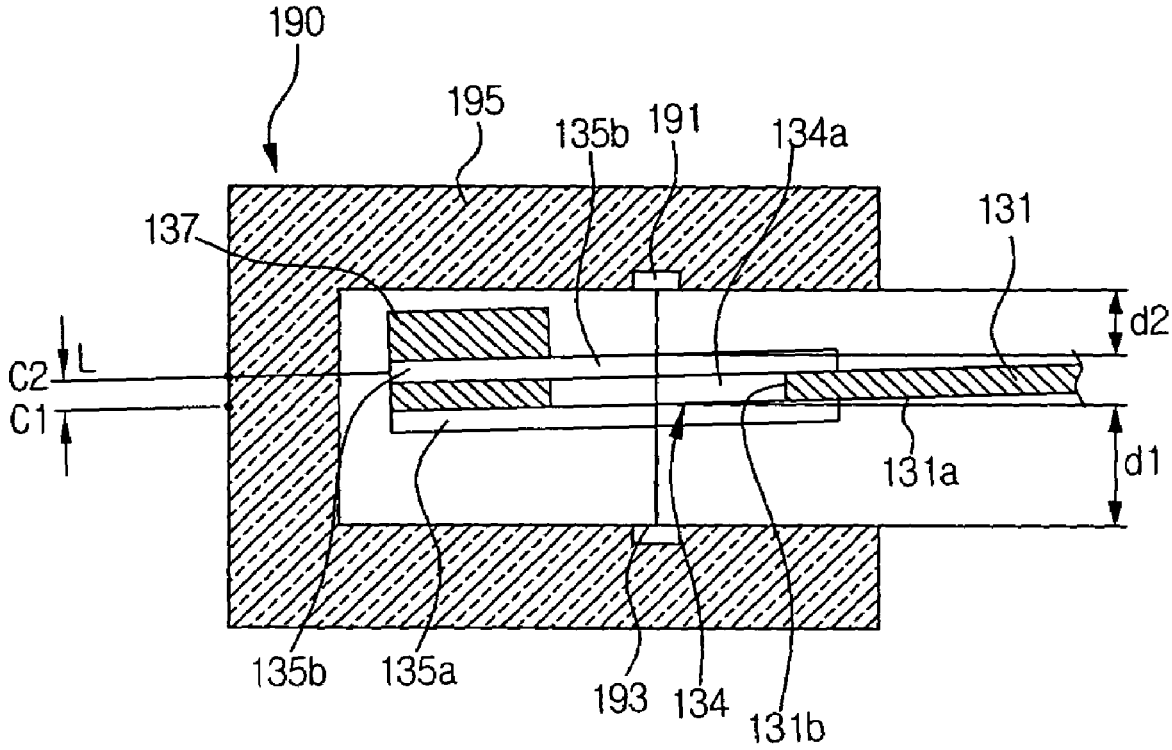
FIG. 6 is a sectional view in cross section along along the line VI-VI of FIG. 4.

FIG. 6 is a sectional view taken along the line VI-VI of FIG. 4.

With reference to FIG. 6, a light penetrating portion 134 is provided at one side of one end of the transfer belt 131. The light penetrating portion 134 includes a window hole 131*b* penetrating the transfer belt 131, wherein the window hole 131*b* is inserted with an additional window member 134*a*. Alternatively, the window hole 131*b* may be covered with the protection tape 135*a* and 135*b* without inserting the additional window member 134*a*.

The sensing unit 190 includes a sensing body 195 positioning a first sensing element 191 (referred to as a light emitting portion) and a second sensing element 193 (referred to as a light receiving portion) at both sides of the transfer belt 131 to include one end of the transfer belt between the sensing elements 191 and 193, such that a distance d1 from the transfer surface 131*a* of the transfer belt 131 to the light receiving portion 193 is longer than a distance d2 from the other surface of the transfer belt 131 to the light emitting portion 191. As shown in FIG. 6, the sensing body 195 is structured to have a substantially rectangular frame shape having an opening on side thereof. The positions of the light emitting portion 191 and the light receiving portion 193 are not limited as illustrated in the drawing, and thus, it is possible to apply alternative positions.

To arrange the distance d1 from the transfer surface 131*a* of the transfer belt 131 to the light receiving portion 193 to be longer than the distance d2 from the other surface of the transfer belt 131 to the light emitting portion 191 as described in detail, preferably, the sensing body 195 may be positioned to be inclined at an angle such that the second sensing element 193 is positioned to be further away from the corresponding transfer surface 131*a* of the transfer belt 13.

Preferably, the sensing body 195 may be further moved, at a predetermined distance L, toward the transfer surface 131*a* from a central axis C2 of a whole thickness formed by the protection tape 135*a* and 135*b*, the transfer belt 131 and the guide member 137. The movement direction is orthogonal to the central axis, and consequently, a central axis C1 of the sensing body 195 is formed at the position spaced at the predetermined distance L from the central axis C2.

Preferably, the sensing body 195 may be positioned to be close to a rotation roller 171*d* (hereinafter, referred as a driving roller) in contact with driving power (motor 181 of FIG. 4) among the plurality of rotation rollers 171*a*-171*d*. At this position of the sensing body 195, the transfer belt 131 droops or changes position least.

The sensing structure of the present invention as described above provides an arrangement structure of minimizing the interference of the transfer surface 131*a* with the light receiving portion 193 in the condition that the distances between the light emitting portion 191 and the light receiving portion 193 are limited.

The above-described structure exemplifies that the transfer belt 131 including the guide member 137 is introduced in the middle of the sensing body 195, however, such description applies similarly to the transfer belt 131 without a guide member.

The foregoing embodiment and advantages are merely exemplary and are not to be construed as limiting the present invention. The present teaching may be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An image forming apparatus having an improved home position sensing structure of a transfer belt, comprising:

a light penetrating portion formed at one side of an edge portion of the transfer belt;

a protection tape adhered to both sides of the edge portion to cover the light penetrating portion;

a guide member attached to one side of the protection tape;

a plurality of rotation rollers driving the transfer belt in a caterpillar-type manner and including a guide groove formed at both ends of each rotation roller such that the guide member is received therein; and a sensing body receiving one end of the transfer belt to be positioned within the inside of the sensing body and positioning a first sensing element and a second sensing element within the sensing body such that a second distance from a transfer surface of the transfer belt to the second sensing element is longer than a first distance from the other surface of the transfer belt to the first sensing element, wherein the sensing body is positioned to be inclined at a predetermined non-zero angle toward the transfer belt, such that the second sensing element is positioned to be further away from the corresponding transfer surface of the transfer belt.

2. The apparatus as claimed in claim 1, wherein the sensing body is further positioned such that a first central axis of a whole thickness, which is defined by the protection tape, the transfer belt and the guide member, is spaced from a second central axis of the sensing body to decrease the second distance.

3. The apparatus as claimed in claim 1, wherein the sensing body is positioned to be close to a driving roller in contact with driving power among the plurality of rotation rollers.

4. An image forming apparatus having an improved home position sensing structure of a transfer belt, comprising:

a light penetrating portion formed at an edge portion of the transfer belt; and a sensing body receiving one end of the transfer belt to be positioned within the inside of the sensing body and positioning a first sensing element and a second sensing element within the sensing body, such that a second distance from a transfer surface of the transfer belt to the second sensing element is longer than a first distance from the other surface of the transfer belt to the first sensing element, wherein the sensing body is positioned to be inclined at a predetermined non-zero angle in the opposite direction of the transfer surface of the transfer belt, such that the second sensing element is positioned to be further away from the corresponding transfer surface of the transfer belt.

5. The apparatus as claimed in claim 4, wherein the sensing body is further positioned such that a first central axis of a thickness of the transfer belt is spaced from a second central axis of the sensing body to decrease the second distance.

6. The apparatus as claimed in claim 4, wherein the sensing body is positioned at a position close to a driving roller to which power is transferred to drive the transfer belt in the caterpillar-type manner.

7. A color image forming apparatus, comprising:

a photosensitive drum for forming an electrostatic latent image on an outer surface thereof;

a development unit forming a visible image by sequentially supplying different toner to the electrostatic latent image formed on the photosensitive drum;

a transfer belt driven in a caterpillar-type manner in contact with the photosensitive drum to transfer the visible image formed on the photosensitive drum onto a recording medium;

a light penetrating portion formed at an edge portion of the transfer belt;

a protection tape adhered to both sides of the edge portion to cover the light penetrating portion;

a guide member attached at one side of the protection tape;

a transfer roller transferring a color image formed on the transfer belt onto the recording medium passing the transfer roller in contact with the transfer belt;

a plurality of rotation rollers including a guide groove formed at both ends of each rotation roller, the guide groove slidably receiving the corresponding guide member when the transfer belt is driven in the caterpillar-type manner; and a sensing body receiving one end of the transfer belt therein and positioning both a first sensing element and a second sensing element within the sensing body such that a second distance from a transfer surface of the transfer belt to the second sensing element is longer than a first distance from the other surface of the transfer belt to the first sensing element, wherein the sensing body is positioned to be inclined at a predetermined non-zero angle in the opposite direction of the transfer surface of the transfer belt, such that the second sensing element is positioned to be further away from the corresponding transfer surface of the transfer belt.

8. A method of disposing a home position sensing apparatus of a transfer belt for an image forming apparatus, comprising the steps of disposing one end of the transfer belt within a sensing body in which a first sensing element and a second sensing element are disposed to correspond to each other and spaced apart by a predetermined distance;

positioning the one end of the transfer belt between the first sensing element and the second sensing element such that a second distance from a transfer surface of the transfer belt to the second sensing element is longer than a first distance from the other surface of the transfer belt to the first sensing element, the sensing body being positioned to be inclined at a predetermined non-zero angle in the opposite direction of the transfer surface of the transfer belt such that the second sensing element is positioned to be further away from the corresponding transfer surface of the transfer belt; and passing the transfer belt through the sensing body to determine a home position of the transfer belt.

9. The method as claimed in claim 8, wherein the sensing body is further positioned by a predetermined distance from a central axis of a thickness of the transfer belt in a direction that decreases the second distance.

10. The method as claimed in claim 8, wherein the sensing body is positioned to be close to a driving roller in contact with driving power among the plurality of rotation rollers rotating the transfer belt.

11. A method of disposing a home position sensing apparatus of a transfer belt for an image forming apparatus, comprising the steps of disposing a transfer belt to be positioned within a sensing body that supports a first sensing element and a second sensing element that correspond to each other and that are spaced apart by a predetermined distance, wherein the transfer belt includes a light penetrating portion formed at one side of an edge portion of the transfer belt, a protection tape adhered to both sides of the edge portion to cover the light penetrating portion, and a guide member attached to one side of the protection tape;

positioning one end of the transfer belt between the first sensing element and the second sensing element such that a second distance from a transfer surface of the transfer belt to the second sensing element is longer than a first distance from the other surface of the transfer belt to the first sensing element, the sensing body being positioned to be inclined at a predetermined non-zero angle in the opposite direction of the transfer surface of the transfer belt such that the second sensing element is positioned to be further away from the corresponding transfer surface of the transfer belt; and passing the transfer belt through the sensing body to determine a home position of the transfer belt.

12. The method as claimed in claim 11, wherein the sensing body is further positioned by a predetermined distance from a central axis of a whole thickness, which is defined by the protection tape, the transfer belt and the guide member, in a direction that decreases the second distance.

13. The method as claimed in claim 11, wherein the sensing body is positioned to be close to a driving roller in contact with driving power among a plurality of rotation rollers rotating the transfer belt.

14. A home position sensing structure to sense a home position of a transfer belt of an image forming apparatus, comprising:

a light penetrating portion formed at an edge portion of the transfer belt, the transfer belt having a first surface and a second surface; and a sensing body receiving the light penetrating portion of the transfer belt, the sensing body having first and second sensing elements such that a first distance from the first surface of the transfer belt to the first sensing element is longer than a second distance from the second surface of the transfer belt to the second sensing element, wherein the sensing body is positioned to be inclined at a predetermined non-zero angle toward the transfer belt such that the first sensing element is further from the first surface of the transfer belt than the second sensing element is from the second surface of the transfer belt.

15. The home position sensing structure of claim 14, wherein the first surface of the transfer belt is a transfer surface of the transfer belt.

16. The home position sensing structure of claim 14, wherein protection tape is adhered to first and second sides of the edge portion of the transfer belt to cover the light penetrating portion.

17. The home position sensing structure of claim 14, wherein a guide member is attached to the protection tape adhered to either a first side or a second side of the transfer belt.

18. The home position sensing structure of claim 17, wherein a plurality of rotation rollers that drive the transfer belt have a guide groove formed at an end of each rotation roller to receive the guide member.

19. The home position sensing structure of claim 18, wherein the sensing body is positioned such that a second central axis of the sensing body is spaced from a first central axis of a thickness defined by the protection tape, the transfer belt and the guide member in a direction that decreases the distance between the second sensing element and the second surface of the transfer belt.

* * * * *

UNITED STATES PATENT AND TRADEMARK OFFICE

CERTIFICATE OF CORRECTION

PATENT NO. : 7,664,443 B2
APPLICATION NO. : 11/489516
DATED : February 16, 2010
INVENTOR(S) : Moon-bae Park It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 756 days.

Signed and Sealed this

Twenty-eighth Day of December, 2010

David J. Kappos

David J. Kappos
*Director of the United States Patent and Trademark Office*